US007647652B1

(12) United States Patent
Baker

(10) Patent No.: US 7,647,652 B1
(45) Date of Patent: Jan. 19, 2010

(54) TOILET SEAT HINGE

(76) Inventor: Theodore W. Baker, 2015 NW. Flanders St. #315, Portland, OR (US) 97209

( * ) Notice: Subject to any disclaimer, the term of this patent is extended or adjusted under 35 U.S.C. 154(b) by 380 days.

(21) Appl. No.: 11/206,501

(22) Filed: Aug. 19, 2005

Related U.S. Application Data

(60) Provisional application No. 60/603,458, filed on Aug. 21, 2004.

(51) Int. Cl.
*A47K 13/12* (2006.01)

(52) U.S. Cl. ..... 4/236

(58) Field of Classification Search ..... 4/234, 4/236, 240; 16/267; 220/836, 840, 843–844
See application file for complete search history.

(56) References Cited

U.S. PATENT DOCUMENTS

| | | | | |
|---|---|---|---|---|
| 3,550,164 | A * | 12/1970 | Pease | 4/236 |
| 3,802,000 | A | 4/1974 | Waldon | |
| 3,820,175 | A | 6/1974 | Waldon | |
| 3,916,459 | A * | 11/1975 | Ivanceyic | 4/213 |
| 4,197,596 | A | 4/1980 | Fantetti | |
| 4,342,124 | A | 8/1982 | Paredes | |
| 4,367,567 | A * | 1/1983 | Sendoykas | 16/263 |
| 4,438,535 | A * | 3/1984 | Paredes | 4/234 |
| 4,680,816 | A * | 7/1987 | Colombani | 4/240 |
| 4,939,796 | A | 7/1990 | Pepper | |
| 4,965,890 | A | 10/1990 | Fischer | |
| 4,970,731 | A | 11/1990 | Fait | |
| 5,175,891 | A | 1/1993 | Ohshima et al. | |
| 5,251,338 | A | 10/1993 | Light | |
| 5,279,000 | A | 1/1994 | Mercier et al. | |
| 5,448,781 | A | 9/1995 | Miller | |
| 5,724,683 | A | 3/1998 | Sorimachi et al. | |
| 5,906,010 | A | 5/1999 | Suzuki | |
| 5,918,322 | A | 7/1999 | Yamamoto et al. | |
| 5,937,448 | A | 8/1999 | Brill et al. | |
| 6,052,869 | A | 4/2000 | Suzuki | |
| 6,085,360 | A * | 7/2000 | Yoke et al. | 4/234 |
| 6,178,597 | B1 | 1/2001 | Suzuki et al. | |
| 6,243,884 | B1 | 6/2001 | Simonson | |
| 6,275,999 | B1 | 8/2001 | Fujita | |
| 6,308,346 | B1 | 10/2001 | Brill et al. | |
| 6,339,851 | B1 | 1/2002 | Bergkvist | |
| 6,381,762 | B1 | 5/2002 | Moser | |
| 6,389,611 | B2 | 5/2002 | Fujita | |
| 6,421,842 | B1 | 7/2002 | Fujita | |
| 6,449,780 | B1 | 9/2002 | Merry | |
| 6,757,917 | B2 | 7/2004 | Kamysz et al. | |
| 2003/0196297 | A1 | 10/2003 | Gerali et al. | |
| 2004/0000029 | A1 | 1/2004 | Miller | |

* cited by examiner

*Primary Examiner*—Huyen Le
(74) *Attorney, Agent, or Firm*—Theodore W. Baker

(57) ABSTRACT

A toilet seat hinge and a toilet seat assembly comprising the toilet seat hinge are disclosed. The disclosed toilet seat hinge is configured to eliminate or reduce the number of gaps, edges, sharp corners and/or exposed surfaces found in and around conventional toilet seat hinges. This can be done, for example, without compromising simplicity or manufacturability. Several features of the disclosed toilet seat hinge make it easier to clean than conventional toilet seat hinges. The seat and lid, for example, can be attached to rotatable elements that are cradled in a base and rotate on substantially the same axis. The profile of the hinge can be streamlined with numerous concave surfaces. Portions of the seat and lid that are not connected to one of the rotatable elements can slide against other elements, so as not to create gaps or sharp corners.

20 Claims, 8 Drawing Sheets

TOILET SEAT HINGE

CROSS REFERENCE TO RELATED APPLICATION

This claims the benefit of prior U.S. Provisional Patent Application No. 60/603,458, filed Aug. 21, 2004, now expired, which is incorporated herein by reference.

FIELD

This disclosure concerns toilet seat hinges and toilet seat assemblies incorporating these hinges.

BACKGROUND

Most conventional toilet seat assemblies include a seat and a lid. The seat and the lid typically are connected to a toilet body by two hinged brackets. Each hinged bracket has a hole that lines up with a mounting hole on the toilet body. To secure the toilet seat assembly to the toilet body, bolts are strung through the brackets and the underlying mounting holes. These bolts are held in place by nuts. The bolt heads often are covered with caps for aesthetic purposes.

Conventional toilet seat assemblies can be difficult to clean. This is at least partially due to gaps created in and around the hinge area. For example, a large gap often is created between the brackets and below the back portion of the seat. Another gap is created between the back portion of the seat and the back portion of the lid. Other gaps are created within and around the hinge area when the seat or lid is moved.

In addition to gaps, conventional toilet seat assemblies, when installed, create sharp angles and edges, which also are difficult to clean. For example, the moving parts of the hinge area typically separate and create sharp angles when the seat or lid is moved. Other sharp angles are created around the hinge area where it meets the mounting surface. In addition, the middle portions of the back sides of the seat and lid typically are exposed and difficult to access.

Toilet seat assemblies, particularly in hotels and public restrooms, require regular cleaning. Gaps, edges, sharp corners, and numerous exposed surfaces make it difficult to adequately clean the hinge areas of conventional toilet seat assemblies. Simply wiping the hinge area with a rag or paper towel usually is not sufficient. In fact, most common cleaning techniques are ill suited for penetrating gaps and conforming to sharp corners.

There is a need for toilet seat hinges that are easier to clean, such as toilet seat hinges that have fewer gaps, edges, sharp corners and/or exposed surfaces when incorporated into toilet seat assemblies and installed on toilet bodies.

SUMMARY

Disclosed herein are embodiments of a toilet seat hinge. Some embodiments of the disclosed hinge are configured to connect at least a seat to a toilet body. The toilet body can, for example, have a substantially flat mounting surface with a first mounting hole and a second mounting hole. Embodiments of the disclosed hinge can have a substantially unified footprint configured to cover both the first mounting hole and the second mounting hole. The hinge also can be configured, for example, to substantially cover a portion of the mounting surface along a substantially continuous path extending from the first mounting hole to the second mounting hole. The path can be straight or curved.

When installed on a toilet body, embodiments of the disclosed toilet seat hinge can have front and back surfaces that abut the mounting surface at front and back surface junctions, respectively. In some embodiments, the front and back surfaces are at least partially concave.

The disclosed toilet seat hinge can, for example, have a base configured to fixedly attach to the mounting surface, a first rotatable element configured to attach to a seat and a second rotatable element configured to attach to a lid. The base can include a tower for holding the first and second rotatable elements in place. In some embodiments, the base also includes a conformable pad positioned to be adjacent to the mounting surface when the hinge is installed on a toilet body. When assembled, the first and second rotatable elements can be configured to rotate on substantially the same axis, which can be curved or straight.

Some embodiments of the disclosed toilet seat hinge are designed to be manufactured in pieces. For example, some disclosed embodiments comprise a base configured to be manufactured as a first piece, a first rotatable element configured to be manufactured with a seat as a second piece and a second rotatable element configured to be manufactured with a lid as a third piece. These pieces can be assembled alone or with other components to form a toilet seat assembly In addition to the hinge, some disclosed embodiments include a seat and/or a lid, such as a seat and/or a lid each having a back side with a middle portion. In some disclosed embodiments there are substantially no gaps greater than about 1 millimeter between the middle portion of the back side of the seat and the hinge as the seat is moved between a closed position and an open position. Similarly, in some disclosed embodiments, there are substantially no gaps greater than about 1 millimeter between the middle portion of the back side of the lid and the hinge as the lid is moved between a closed position and an open position. Substantially all of the middle portion of the back side of the seat and/or substantially all of the middle portion of the back side of the lid, for example, can be either connected to or slidably abut the hinge. In some embodiments, the back side of the seat substantially abuts a rotatable element attached to the lid. Similarly, the back side of the lid can substantially abut a rotatable element attached to the seat.

The seat and lid can attach to the hinge at a seat attachment portion and a lid attachment portion, respectively. In some disclosed embodiments, the seat and lid attachment portions have top and bottom surfaces that are configured so as not to create sharp corners where they meet the hinge. The top and bottom surfaces, for example, can be at least partially concave. In some disclosed embodiments, at least two of the top surface of the seat attachment portion, the bottom surface of the seat attachment portion, the top surface of the lid attachment portion, and the bottom surface of the lid attachment portion are at least partially concave.

Some disclosed embodiments comprise one or more fixed elements and two or more rotatable elements and are configured to allow the independent movement of a seat and a lid between a closed position and an open position. These embodiments can be configured such that there are substantially no corners with angles between about 1° and about 100° between the two or more rotatable elements and/or between the two or more rotatable elements and the one or more fixed elements as the seat or the lid is moved between the closed position and the open position.

In embodiments comprising a first rotatable element configured to attach to a seat and a second rotatable element configured to attach to a lid, the rotatable elements can have various exposed surfaces when the seat and lid are in different positions. The rotatable elements can be configured so that these exposed surfaces are substantially flush with each other and with adjacent exposed surfaces so that substantially no gaps greater than about 1 millimeter and/or substantially no corners with angles between about 1° and about 100° are created as the seat or the lid is moved between the closed position and the open position.

BRIEF DESCRIPTION OF DRAWINGS

FIG. 3B is an enlarged view of a section of the middle portion of the back side of the seat in the embodiment illustrated in FIG. 3A.

DETAILED DISCUSSION

Throughout this disclosure, the singular terms "a," "an," and "the" include plural referents unless the context clearly indicates otherwise. Similarly, the word "or" is intended to include "and" unless the context clearly indicates otherwise.

Disclosed herein are embodiments of a toilet seat hinge for securing at least a seat to a toilet body, such as a standard toilet body. A standard toilet body typically includes a bowl and a tank. Between the bowl and the tank is a mounting surface penetrated by two mounting holes designed to receive bolts that can be used to secure a toilet seat assembly to the toilet body. The mounting holes can be positioned symmetrically near the rear of the bowl on side portions of the mounting surface with flat undersides. The center of the first mounting hole often is separated from the center of the second mounting hole by a distance of approximately 14 centimeters (5.5 inches). The spacing of the mounting holes is an industry standard and allows for broad compatibility between toilet seat assemblies and toilet bodies. Embodiments of the disclosed toilet seat hinge can be used with standard toilet bodies, including standard mounting hole configurations, or non-standard toilet bodies, including non-standard mounting hole configurations.

Figure 1A:
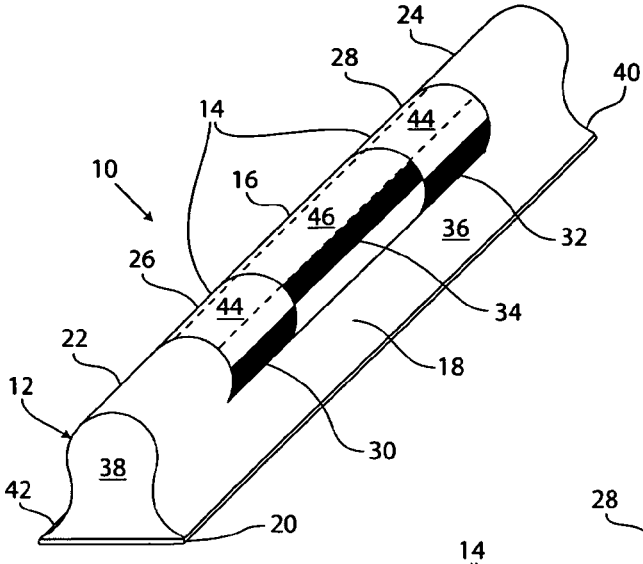
FIGS. 1A-1C are perspective views of one embodiment of the disclosed toilet seat hinge.
Figure 1B:
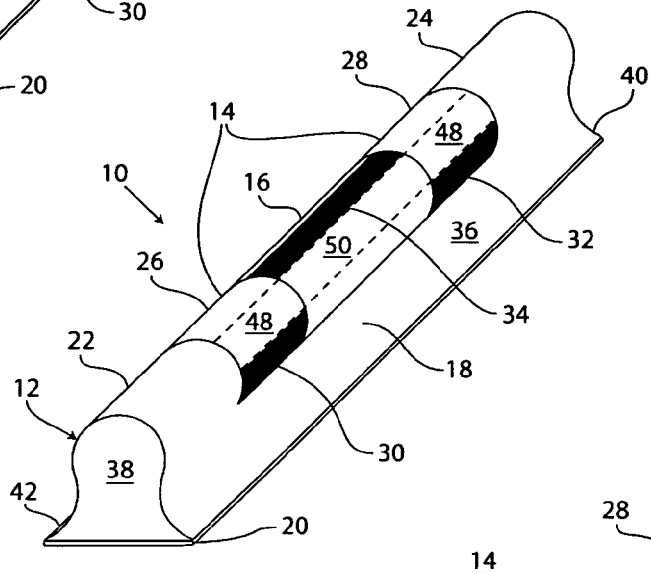
Figure 1C:
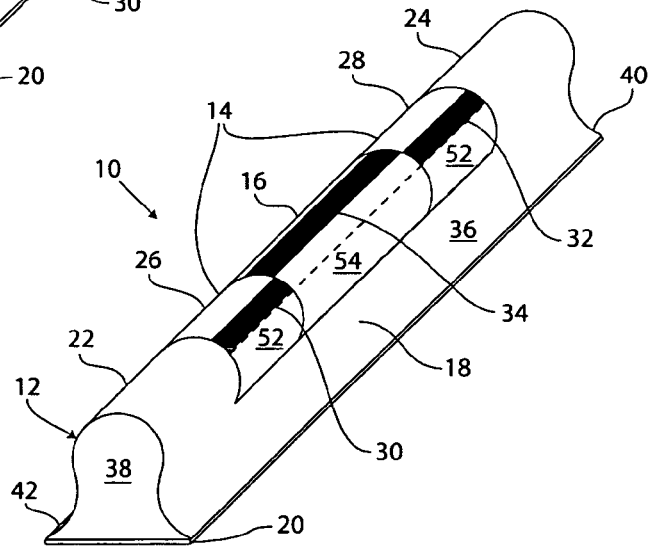

By way of introduction, FIGS. 1A-C illustrate one embodiment of the disclosed toilet seat hinge. This embodiment is exemplary only and not intended to limit the scope of the overall disclosure. FIGS. 1A-C show a toilet seat hinge 10 comprising a base 12, a first rotatable element 14 and a second rotatable element 16. The base 12 comprises a cradle 18, a pad 20, a first tower 22 and a second tower 24. The first rotatable element 14 comprises a first section 26 and a second section 28. The second rotatable element 16 is positioned between the first section 26 and the second section 28. The first section 26 and the second section 28 are attached to a seat (not shown) at a first seat attachment area 30 and a second seat attachment area 32, respectively. Similarly, the second rotatable element 16 is attached to a lid (not shown) at a lid attachment area 34. The first rotatable element 14 and the second rotatable element 16 rotate on substantially the same axis and are supported on an axle (not shown). The axle passes through the first rotatable element 14 and the second rotatable element 16 and is supported on its ends by the first tower 22 and the second tower 24. The base 12, including the cradle 18, the pad 20, the first tower 22 and the second tower 24, is fixed when the toilet seat hinge 10 is installed on a toilet body.

The toilet seat hinge 10 has a front surface 36, two side surfaces 38 and a back surface (not shown). The front surface 36 has a front flared bottom portion 40. Similarly, the back surface has a back flared bottom portion 42. The front surface 36 and the back surface are concave as they extend toward the front flared bottom portion 38 and the back flared bottom portion 42, respectively.

FIGS. 1A-C each illustrate the toilet seat hinge 10 with the seat and lid in various positions. Each figure has a continuous exposed portion surrounded by a dashed line. In FIG. 1A, the seat and lid are in a closed position. In this configuration, the first rotatable element 14 has an exposed back surface 44 and the second rotatable element 16 has an exposed back surface 46. In FIG. 1B, the seat is in the closed position and the lid is in the open position. In this configuration, the first rotatable element 14 has an exposed middle surface 48 and the second rotatable element 16 has an exposed middle surface 50. In FIG. 1C, the seat and lid are in the open position. In this configuration, the first rotatable element 14 has an exposed front surface 52 and the second rotatable element 16 has an exposed front surface 54.

The lid and seat, when present, slidably abut the first rotatable element 14 and the second rotatable element 16, respectively. The lid slidably abuts the first rotatable element 14 on the portions of the first rotatable element 14 directly adjacent to the sides of the lid attachment area 34. Similarly, the seat slidably abuts the second rotatable element 16 on the portion of the second rotatable element 16 directly between first seat attachment area 30 and the second seat attachment area 32.

Figure 2A:
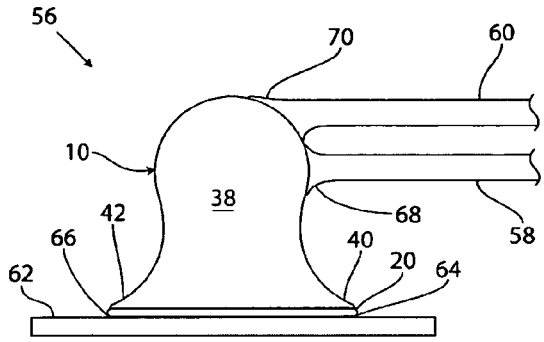
FIGS. 2A-2C are side elevation views of the embodiment illustrated in FIG. 1, further including a seat and a lid.
Figure 2B:
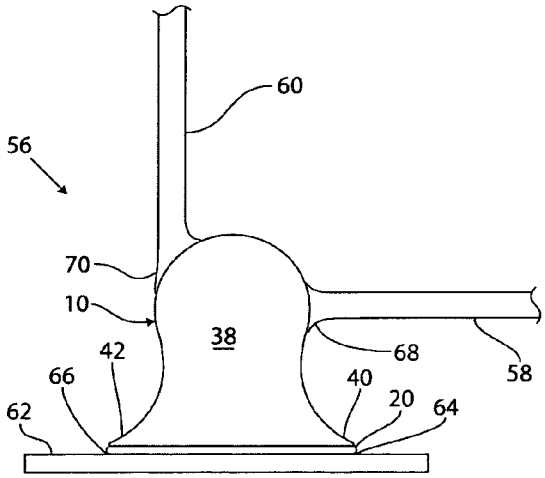
Figure 2C:
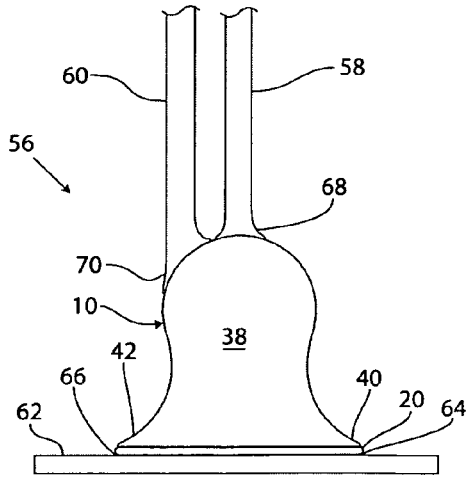

FIGS. 2A-C are side elevation views of a toilet seat assembly 56 comprising the toilet seat hinge 10 illustrated in FIGS. 1A-C along with a seat 58 and a lid 60. The reference numerals from FIGS. 1A-C are carried over to FIGS. 2A-C. In FIGS. 2A-C, the toilet seat hinge 10 is mounted on a mounting surface 62. The front flared bottom portion 40 and the back flared bottom portion 42 meet the mounting surface 62 at a front surface junction 64 and a back surface junction 66, respectively. The front flared bottom portion 40 and the back flared bottom portion 42 curve as they approach the mounting surface 62, so that no sharp corners are created along the front surface junction 64 or the back surface junction 66. There is, however, a small lip adjacent to the front surface junction 64 and the back surface junction 66, created, in part, by the pad 20.

FIGS. 2A-C illustrate the curvatures of the interfaces between the seat 58 and the toilet seat hinge 10 and between the lid 60 and the toilet seat hinge 10. The seat 58 has a seat attachment portion 68 that is connected to the first rotatable element and slidably abuts the second rotatable element and the first and second towers. The lid 60 has a lid attachment portion 70 that is connected to the second rotatable element and slidably abuts the first rotatable element and the first and second towers. The bottom surface of the lid attachment portion 70 and the top and bottom surfaces of the seat attachment portion 68 are curved to eliminate sharp corners where they meet the rotatable elements and towers. The top surface of the lid attachment portion 70 is generally straight because it is approximately tangential to the profile of the rotatable elements and towers and therefore does not create a sharp angle where it meets the rotatable elements and towers.

In FIG. 2A, the seat 58 and the lid 60 are in the closed position. In FIG. 2B, the seat 58 is in the closed position and the lid 60 is in the open position. In FIG. 2C, both the seat 58 and the lid 60 are in the open position. By showing the various positions of the seat 58 and the lid 60, FIGS. 2A-C illustrate how the exposed surfaces of the rotatable elements and towers remain in alignment as the seat 58 and the lid 60 are moved between the closed position and the open position.

Figure 3A:
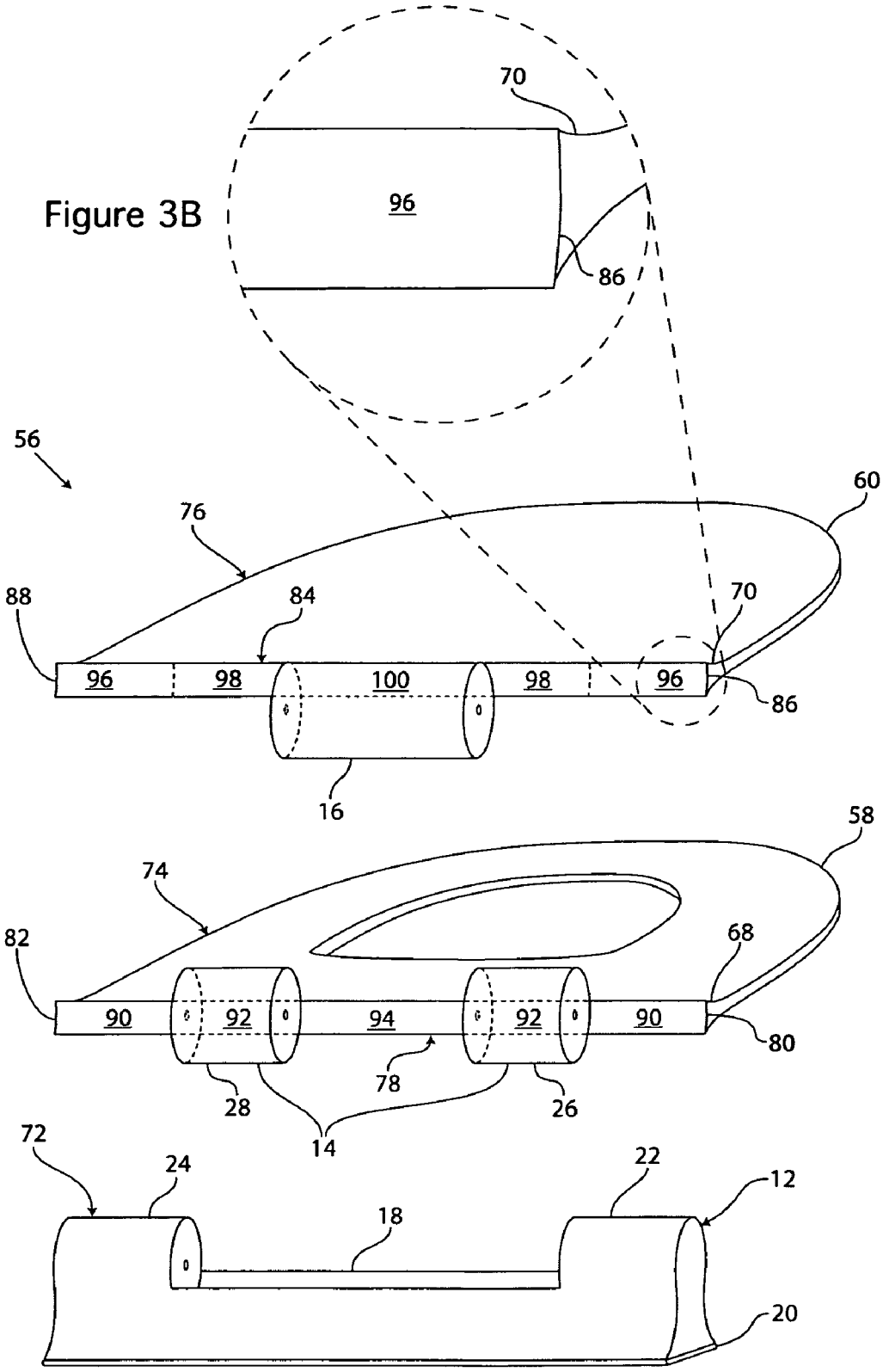
FIG. 3A is an exploded perspective view of the embodiment illustrated in FIG. 2.

FIG. 3A is an exploded perspective view of the embodiment illustrated in FIG. 2. FIG. 3B is an enlarged view of part of the toilet seat assembly 56 illustrated in FIG. 3A. The reference numerals from FIGS. 1 and 2 are carried over to FIGS. 3A and 3B. As shown in FIG. 3A, the toilet seat assembly 56 comprises a first piece 72, a second piece 74 and a third piece 76. The first piece 72 comprises the base 12, including the cradle 18, the pad 20, the first tower 22 and the second tower 24. The second piece 74 comprises the seat 58 and the first rotatable element 14, including the first section 26 and the second section 28. The third piece 76 comprises the lid 60 and the second rotatable element 16.

FIG. 3A illustrates the back sides of the seat 58 and the lid 60. The back side of the seat 58 has a middle portion 78 extending along the seat attachment portion 68 from a first endpoint 80 to a second end point 82. Similarly, the back side of the lid 60 has a middle portion 84 extending along the lid attachment portion 70 from a first endpoint 86 to a second end point 88. The middle portion 78 of the back side of the seat 58 and the middle portion 84 of the back side of the lid 60 each have surfaces that can be visualized in different sections. Beginning from the first and second endpoints 86 and 88, and moving inward, the middle portion 78 of the back side of the seat 58 has a pair of first surface sections 90, a pair of second surface sections 92 and a third surface section 94. Similarly, the middle portion 84 of the back side of the lid 60 has a pair of first surface sections 96, a pair of second surface sections 98 and a third surface section 100. When the toilet seat assembly 56 is assembled, the first surface sections 90 and 96 of the middle portions 78 and 84 of the back sides of the seat and lid 58 and 60 slidably abut the first and second towers 22 and 24. The second surface sections 92 of the middle portion 78 of the back side of the seat 58 are attached to the first rotatable element 14. The second surface sections 98 of the middle portion 84 of the back side of the lid 60 slidably abut the first rotatable element 14. The third surface section 100 of the middle portion 84 of the back side of the lid 60 is attached to the second rotatable element 16. The third surface section 94 of the middle portion 78 of the back side of the seat 58 slidably abuts the second rotatable element 16. The surface sections of the middle portions 78 and 84 of the back sides of the seat and lid 58 and 60 that are not connected to one of the rotatable elements are concave to match the curvature of the rotatable elements and towers that they slidably abut. FIG. 3B illustrates the curvature of the first surface section 96 of the middle portion 84 of the back side of the lid 60 as well as the curvature of the top and bottom surfaces of the lid attachment portion 70.

Figure 4:
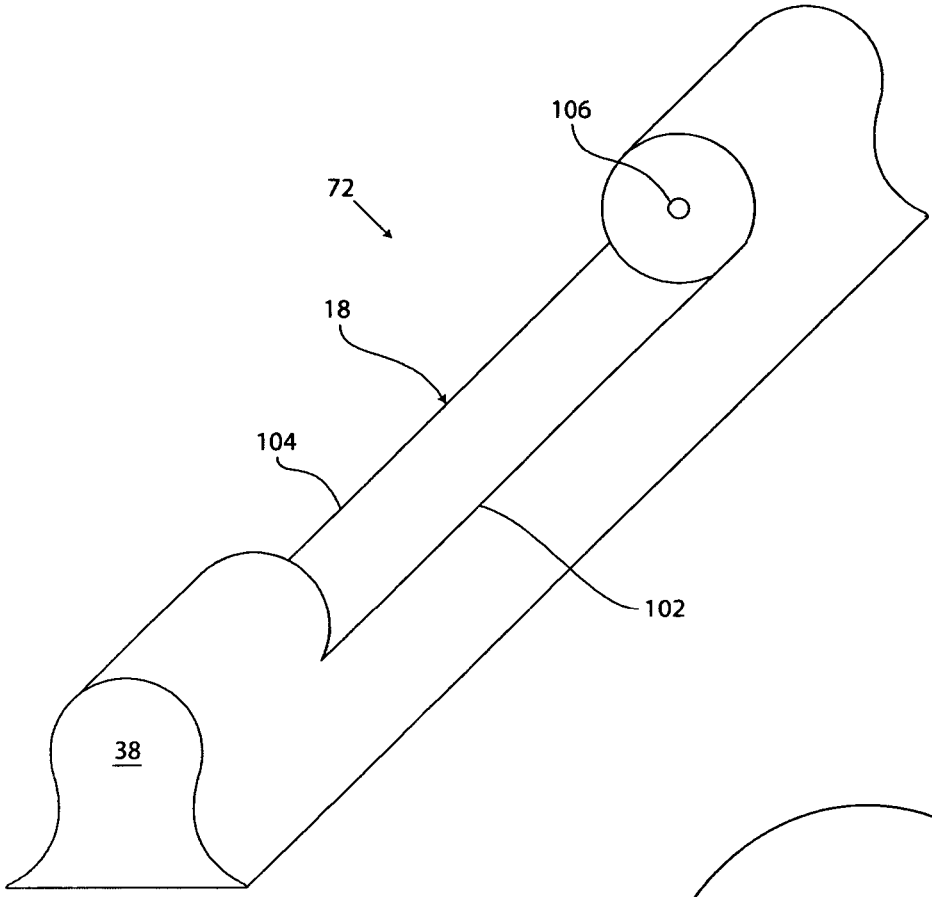
FIG. 4 is a perspective view of the first piece in the embodiment illustrated in FIG. 3.

FIG. 4 is a perspective view of the first piece 72 presented at an angle to better illustrate the curvature of the cradle 18. The reference numerals from FIGS. 1-3 are carried over. The cradle 18 is designed to snugly support the first and second rotatable elements between a front section 102 and a back section 104. The front section 102 and the back section 104 extend up so that their outer surfaces are almost tangential to the curvature of the first and second rotatable elements. This prevents sharp corners from being formed where the first and second rotatable elements emerge from the cradle 18. The first and second rotatable elements are held in place by an axle that fits into a first tower axle hole (not shown) and a second tower axle hole 106. To assemble the toilet seat assembly 56, the axle can be strung through the towers and rotatable elements via an access opening (not shown) on the side surface 38 of the toilet seat hinge 10. The access opening then can be plugged or can remain open for easy disassembly.

Figure 5:
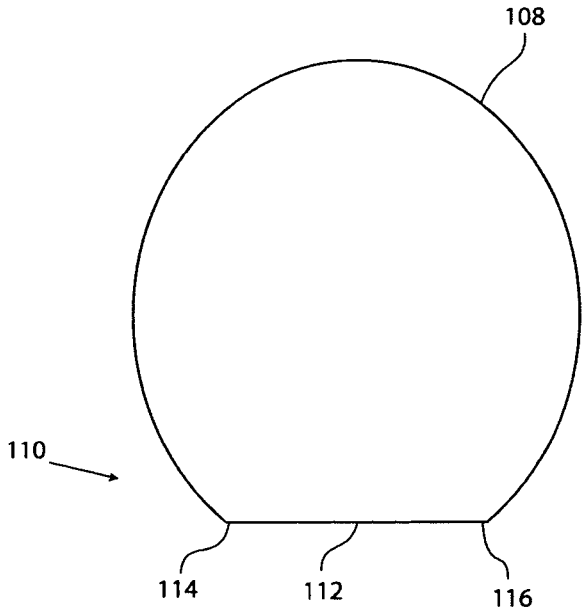
FIG. 5 is a plan view of one embodiment of a lid compatible with some embodiments of the disclosed toilet seat hinge.

In toilet seat assembly 56 illustrated in FIG. 3, the middle portion 78 of the back side of the seat 58 and the middle portion 84 of the back side of the lid 60 encompass essentially the entire back sides of the seat and lid 58 and 60, respectively. In some other embodiments, the seat and lid flare out from the middle portions of their respective back sides. FIG. 5 is a plan view of a lid 108 with a back side 110 that flares out from its middle portion 112. The middle portion 112 extends from a first endpoint 114 to a second end point 116. Typically, the endpoints of the middle portions of the back sides of the seat and lid are in vertical alignment when the seat and lid are installed on a toilet body.

Figure 6:
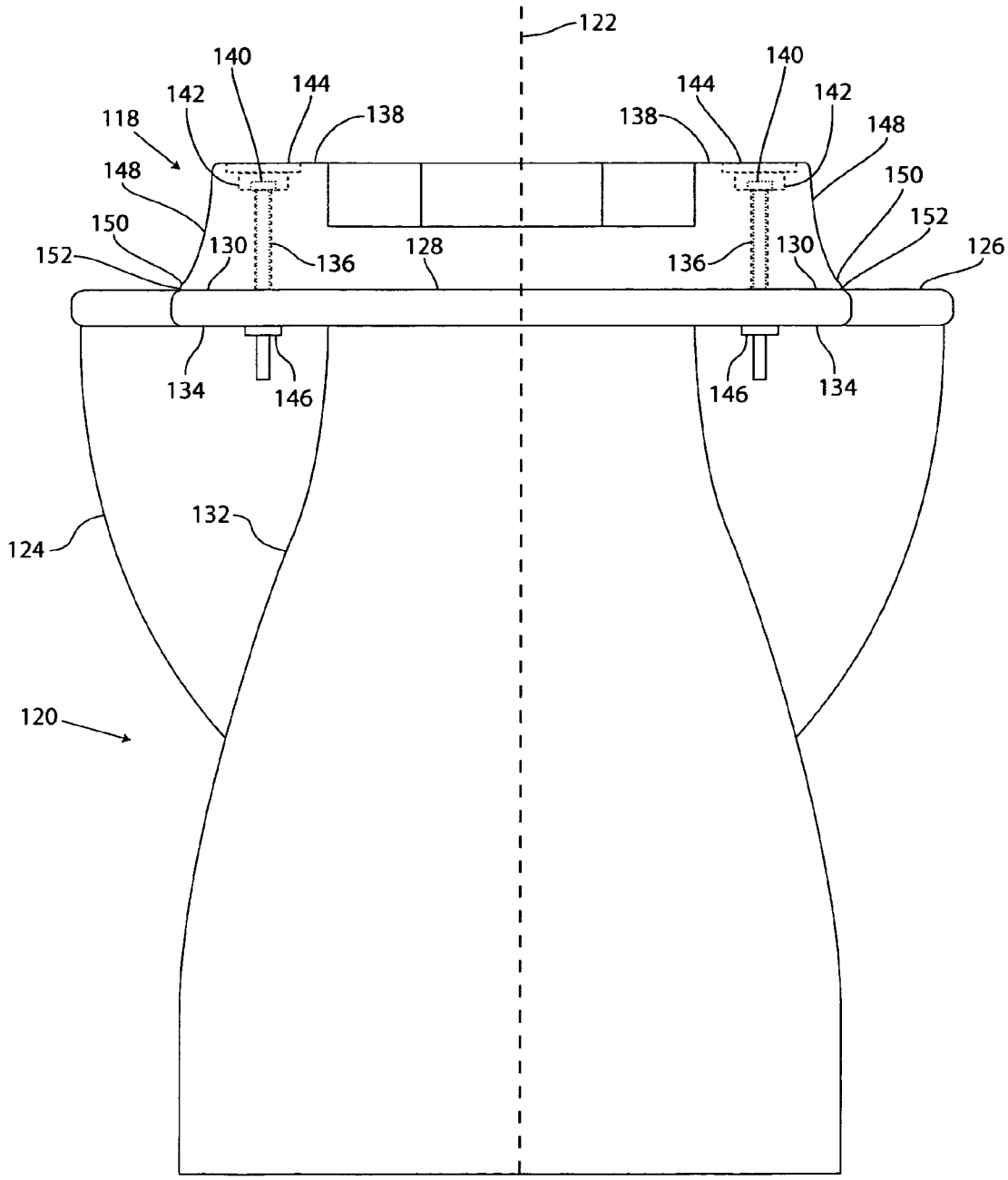
FIG. 6 is a back elevation view of an embodiment of the disclosed toilet seat hinge installed on a toilet body.

FIG. 6 illustrates another embodiment of the disclosed toilet seat hinge. Like the embodiments illustrated in FIGS. 1-5, this embodiment is exemplary only and not intended to limit the scope of the overall disclosure. FIG. 6 shows a toilet seat hinge 118 installed on a toilet body 120. The toilet seat hinge 118 and the toilet body 120 have an axis of symmetry 122. The toilet body 120 has a bowl 124 with a surface edge 126. As the surface edge 126 extends towards a tank (now shown) it turns into a mounting surface 128. The mounting surface 128 has side portions 130 on either side of a support 132. Each of the side portions 130 is perforated with a mounting hole (not shown). The mounting holes extend down through flat undersides 134 of the side portions 130.

The toilet seat hinge 118 is secured to the mounting surface 128 with bolts 136. The bolts 136 are positioned in bolt holes that extend through towers 138. Each bolt 136 has a bolt head 140. The bolt heads 140 are positioned in openings 142 deep enough to recess the bolt heads 140 relative to the top surfaces of the towers 138. The openings 142 are covered by bolt hole covers 144. The bolt hole covers 144 are flush with the surface of the towers 138. Each bolt 136 is held in place by a nut 146 that presses against the flat underside 134 of one of the side portions 130 of the mounting surface 128.

Unlike the embodiment illustrated in FIG. 1, the embodiment illustrated in FIG. 6 does not have a pad. Thus, the bottom surface of the toilet seat hinge 118 rests directly on the mounting surface 128. Also unlike the embodiment illustrated in FIG. 1, the toilet seat hinge 118 has side surfaces 148 with flared bottom portions 150 that are concave. The flared bottom portions 150 of the side surfaces 148 meet the mounting surface 128 at side surface junctions 152 without creating any sharp corners along the side surface junctions 152.

Figure 7:
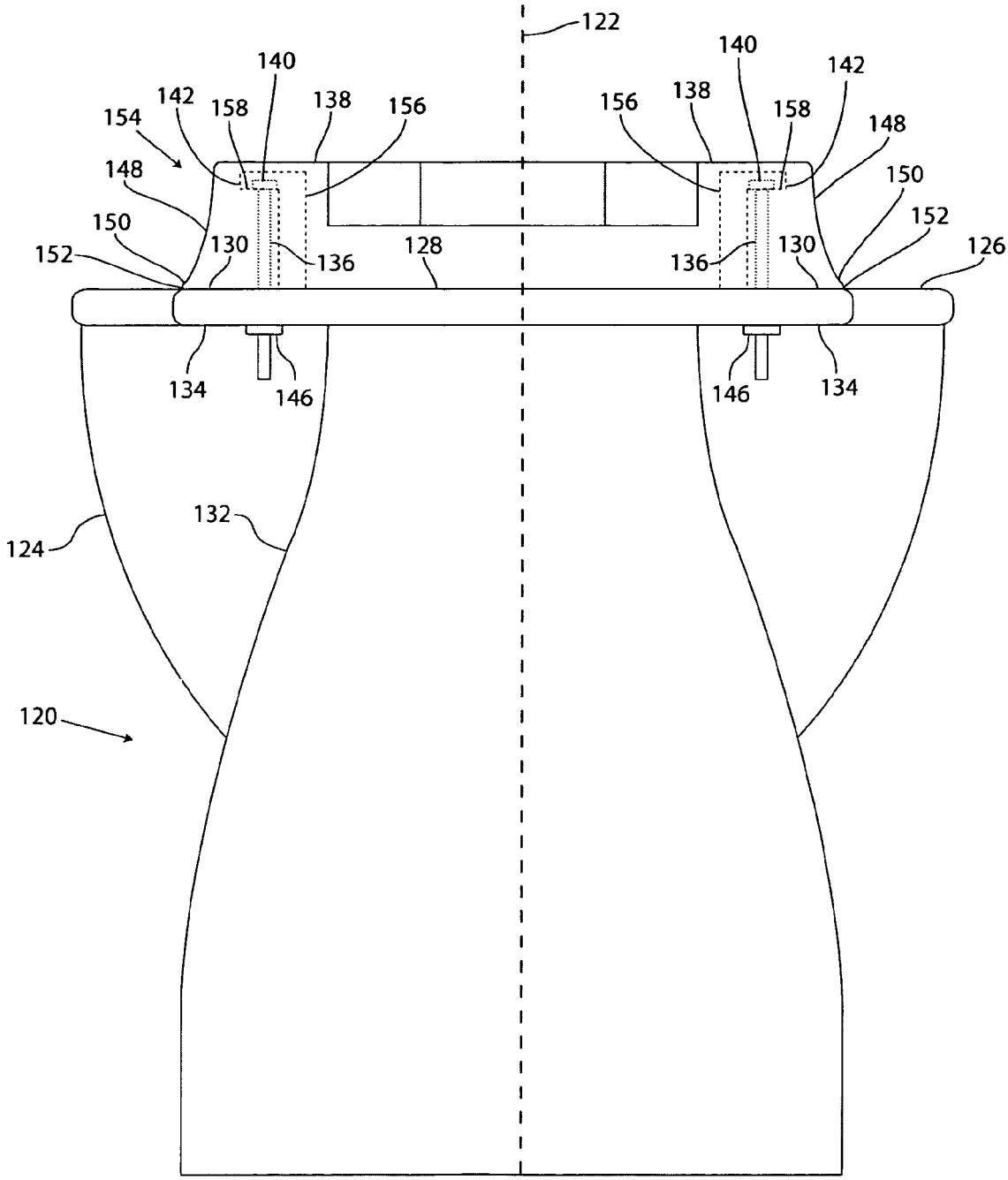
FIG. 7 is a back elevation view of an embodiment of the disclosed toilet seat hinge installed on a toilet body.
Figure 8:
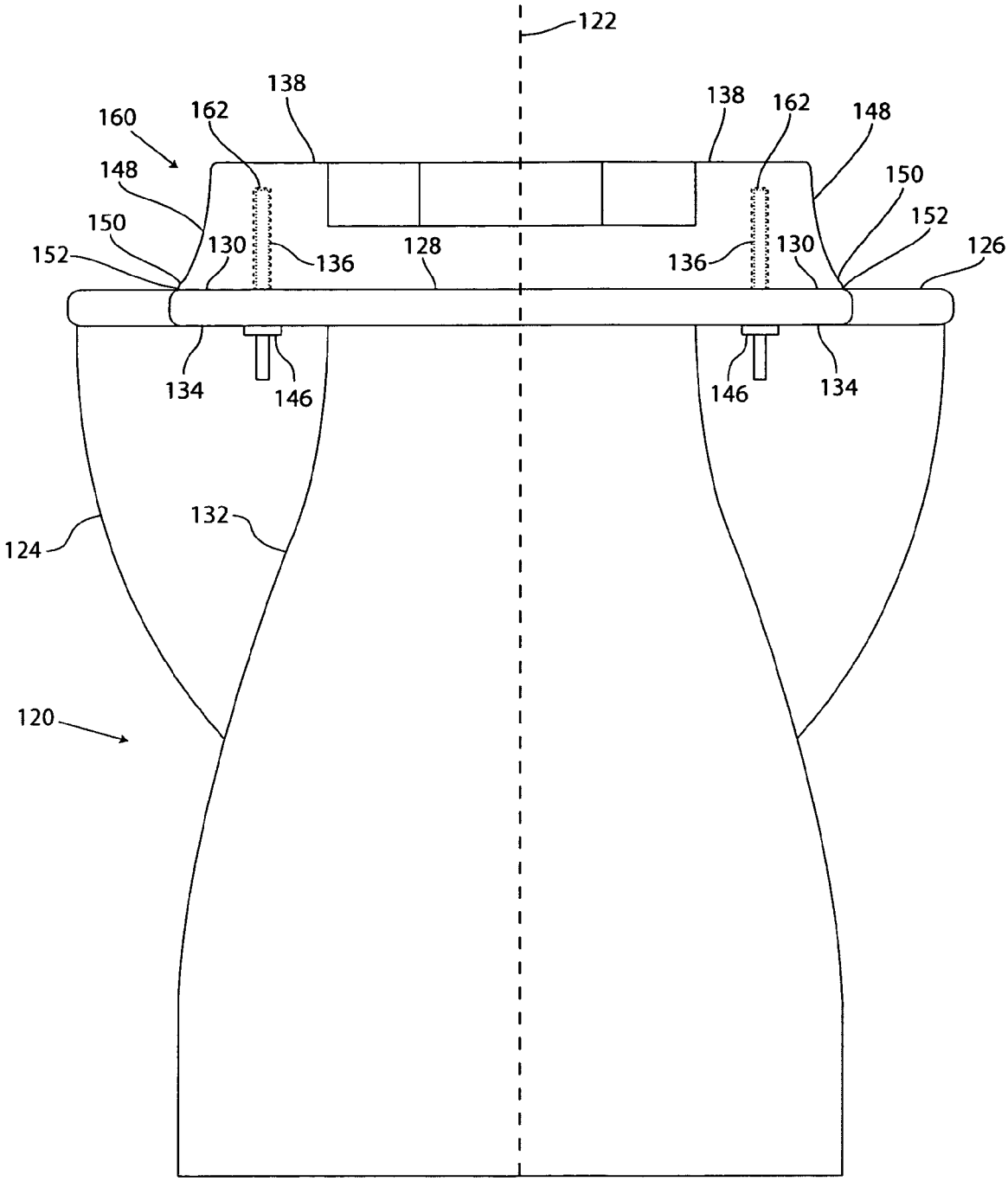
FIG. 8 is a back elevation view of an embodiment of the disclosed toilet seat hinge installed on a toilet body.

FIGS. 7 and 8 illustrate embodiments of the disclosed toilet seat hinge similar to the embodiment illustrated in FIG. 6, but with different bolt configurations. These embodiments are designed to eliminate the need for bolt hole covers 144, which can interrupt otherwise continuous surfaces. Instead, the bolts are attached solely from below through openings that are not exposed when these embodiments are installed on a toilet body 120. In the toilet seat hinge 154 illustrated in FIG. 7, each bolt 136 is lifted vertically through a bolt opening 156 and then shifted horizontally so that the bolt head 140 catches on a lip 158. The exposed portion of the bolt 136 then can be strung through the corresponding mounting hole and secured with a nut 146. In the toilet seat hinge 160 illustrated in FIG.

8, each bolt 136 is received by a threaded opening 162. As with the embodiment illustrated in FIG. 7, the bolt 136 then can strung through the corresponding mounting hole and secured with a nut 146. The bolt 136 need not have a bolt head.

Figure 9:
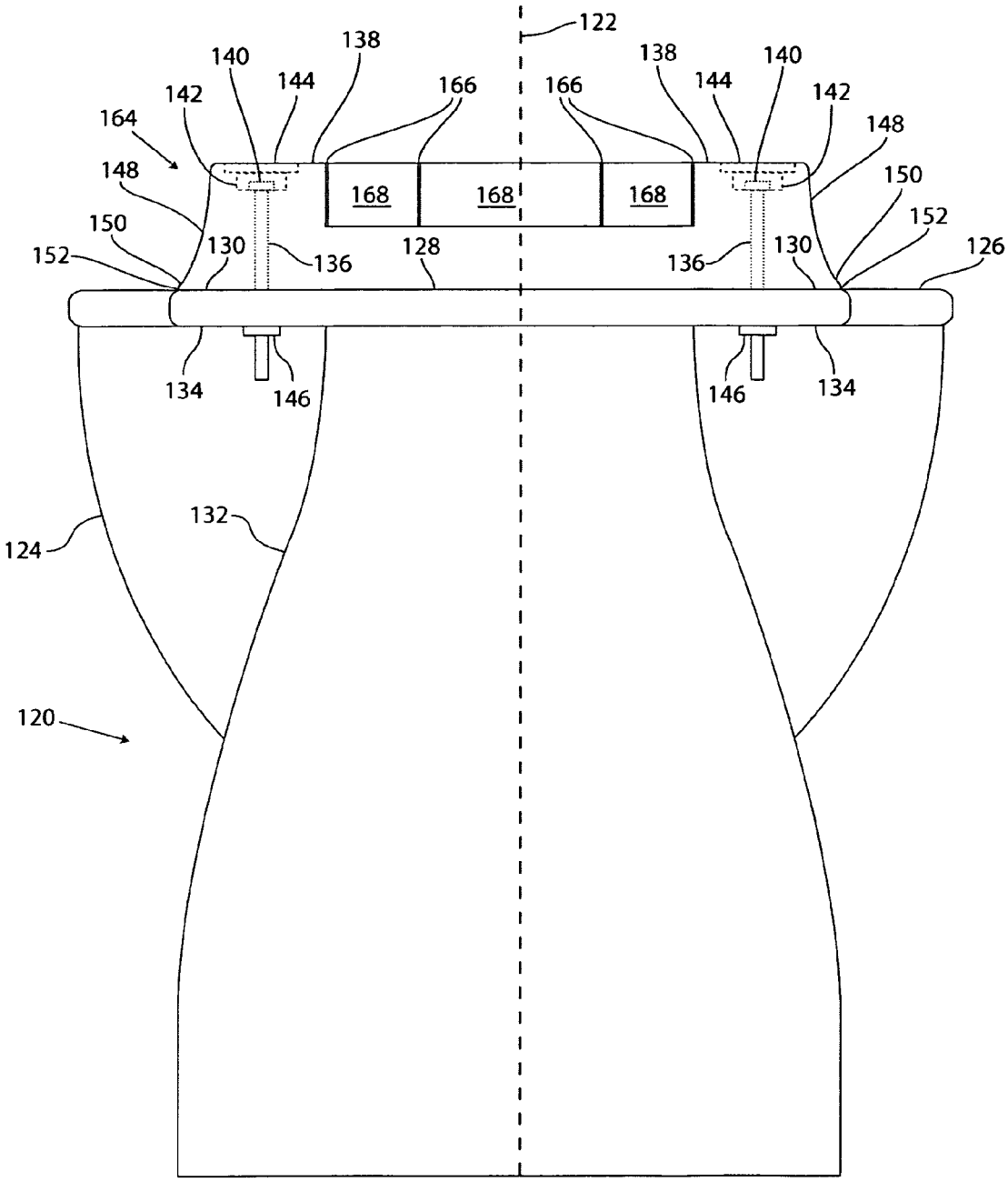
FIG. 9 is a back elevation view of an embodiment of the disclosed toilet seat hinge installed on a toilet body.

FIG. 9 illustrates another embodiment of the disclosed toilet seat hinge. The illustrated toilet seat hinge 164 is similar to the embodiment illustrated in FIG. 6, but with conformable pads 166 between the rotatable elements 168 and between the towers 138 and the rotatable elements 168. These conformable pads 166 help to provide a tight fit between the moving components and to provide the desired level of friction.

The embodiments illustrated in FIGS. 1-9 and other embodiments of the disclosed toilet seat hinge have one or more features that are not found in conventional toilet seat hinges. Some of these features are described in the following subsections.

Eliminating Gaps

Some embodiments of the disclosed toilet seat hinge are designed to eliminate gaps found in and around conventional toilet seat hinges when these hinges are installed on a toilet body. For example, some disclosed embodiments substantially cover the portion of the mounting surface between the mounting holes on a toilet body, such as a standard toilet body. This can, for example, eliminate the gap that is found between the brackets of conventional toilet seat hinges.

Some embodiments of the disclosed toilet seat hinge cover a larger portion of the mounting surface than conventional toilet seat hinges. For example, while most conventional toilet seat hinges only cover two separate patches of the mounting surface, some disclosed embodiments have a unified footprint on the mounting surface that encompasses or surrounds the mounting holes. This footprint can be created, for example, by a base that is connected to the mounting holes. In some disclosed embodiments, the base has a bottom surface that contacts the mounting surface. The bottom surface of the base can be continuous or non-continuous. In some disclosed embodiments, the base is a shell that covers a portion of the mounting surface by contacting the mounting surface at the bottom edge of its front, back, and side surfaces.

Toilet bodies typically are symmetrical and have an axis of symmetry extending from the front of the bowl to the back of the tank. Some embodiments of the disclosed toilet seat hinge are configured to mount to the toilet body substantially centered on the axis of symmetry near the rear of the bowl. In contrast, as mentioned above, conventional toilet seat assemblies typically comprise brackets that are spaced apart on either side of the axis of symmetry.

Embodiments of the toilet seat hinge can comprise a base that supports one or more rotatable elements. The rotatable elements can be positioned, for example, between or around one or more towers. The towers can be configured so that they are directly above the mounting holes when the hinge is installed on a standard toilet body. In some disclosed embodiments, the base comprises a first tower and a second tower and these towers support at least a first rotatable element and a second rotatable element. Portions of the rotatable elements can be positioned, for example, on either side of the towers or between the towers. The first and second towers can support the rotatable elements, for example, by supporting one or more axles about which the rotatable elements rotate. In some disclosed embodiments, a single axle connects each rotatable element. In other disclosed embodiments, multiple axles connect the rotatable elements. For example, a separate axle can be present at each connection point. In still other disclosed embodiments, mating recesses and protrusions connect the rotatable elements. In form, the rotatable elements can comprise, for example, one or more rounded elements configured for attachment to the seat or lid.

In some embodiments of the disclosed toilet seat hinge, a first rotatable element is attached to the seat and a second rotatable element is attached to the lid. The first and second rotatable elements can allow the movement of the seat and lid, respectively, by rotating from a first angle to a second angle. The first and second angles can be separated by a range sufficient to allow the seat and lid to move between a closed position and an open position. This can be a range, for example, from about 70° to about 120°, such as from about 80° to about 110° or from about 90° to about 100°. In some disclosed embodiments, gaps are eliminated by configuring the first and second rotatable elements to rotate on substantially the same axis. This axis can be curved or straight.

In embodiments of the toilet seat hinge comprising a seat and a lid, the seat and lid can have back sides with middle portions. The middle portions are centered on the hinge and are bisected by the toilet body's axis of symmetry. Each middle portion has a width, which can be, for example, between about 2 centimeters and about 30 centimeters, such as between about 10 centimeters and about 25 centimeters or between about 15 centimeters and about 23 centimeters. In some disclosed embodiments, the middle portions are at least partially connected to the hinge. The middle portions of the back sides of the seat and lid on conventional toilet seat hinges comprise exposed edges that are difficult to clean. In contrast, in some disclosed embodiments, at least a portion of or substantially all of the middle portion of the back side of the seat either is connected to or slidably abuts the hinge. Likewise, in some disclosed embodiments, at least a portion of or substantially all of the middle portion of the back side of the lid either is connected to or slidably abuts the hinge.

As mentioned above, some disclosed embodiments are configured to eliminate gaps between the middle portion of the back side of the seat and the hinge as the seat or lid is moved between the closed position and the open position. These and other embodiments also can be configured to eliminate gaps between the middle portion of the back side of the lid and the hinge as the seat or lid is moved between the closed position and the open position. For example, in embodiments in which the seat is attached to a first rotatable element and the lid is attached to a second rotatable element and the first and second rotatable elements rotate on substantially the same axis, an unconnected part of the middle portion of the back side of the seat can be configured to slidably abut the second rotatable element and an unconnected part of the middle portion of the back side of the lid can be configured to slidably abut the first rotatable element. In this way, the seat and lid can be opened and closed without creating any substantial gaps.

The elements of certain embodiments of the disclosed toilet seat hinge preferably are positioned to substantially abut adjacent elements, such as adjacent fixed elements or adjacent movable elements. For example, the rotatable elements can be configured to substantially abut adjacent rotatable elements or adjacent towers. Likewise, the base can be configured to substantially abut the mounting surface. The space, if any, between substantially abutting elements can be any space small enough to eliminate gaps that are difficult to clean. This can be a space, for example, less than about 2 millimeters, such as less than about 1 millimeter or less than about 0.5 millimeter. Likewise, the gaps referred to elsewhere in this disclosure can be, for example, gaps with widths less than about 2 millimeters, such as less than about 1 millimeter or less than about 0.5 millimeter.

Eliminating Sharp Corners

Some embodiments of the disclosed toilet seat hinge are designed to eliminate sharp corners found in and around conventional toilet seat hinges. Sharp corners can be created where a first surface at a first angle meets a second surface a second angle. A sharp corner can be any corner that is difficult to clean, such a corner of substantial size that defines a sharp angle. A sharp angle can be, for example, an angle between about 1° and about 110°, such as between about 1° and about 100° or between about 1° and about 95°. The angle of a curved surface is defined by the average angle of the portion of the surface closest to the meeting point, such as the closest 10 millimeters, 8 millimeters, or 6 millimeters of the surface, excluding small edges. Where a surface extends toward another surface at a first angle and terminates in an edge smaller than about 8 millimeters or, more typically, smaller than about 6 millimeters, smaller than about 4 millimeters, or smaller than about 2 millimeters, the angle of the surface is not defined by the angle of the edge.

Sharp corners can be eliminated in several ways. For example, in some disclosed embodiments, sharp corners are replaced with curved corners that are concave. In comparison to sharp corners, concave corners are much easier to clean. Aligning components and preventing them from separating or becoming skewed when the seat or lid is moved eliminates additional sharp corners.

In some disclosed embodiments, a first rotatable element is attached to the seat and a second rotatable element is attached to the lid. The hinge can be configured so that the first and second rotatable elements rotate on substantially the same axis, which can be straight or curved. This helps to align the moving parts and eliminate sharp corners. For example, in some of disclosed embodiments, there are no sharp corners between the first rotatable element and the second rotatable element as the seat or lid is moved between the closed position and the open position. Some disclosed embodiments also have no sharp corners between the rotatable elements and the fixed elements, such as the base, as the seat or lid is moved between the closed position and the open position. These sharp corners can be eliminated, for example, by cradling the rotatable elements in the top portion of the base. In some disclosed embodiments, the base covers about the bottom quarter to about the bottom half of the rotatable elements, such as about the bottom third to about the bottom half of the rotatable elements.

In some disclosed embodiments, the first and second rotatable elements have various exposed surfaces when the seat and lid are in different positions. For example, when the seat and lid are in the closed position, the first and second rotatable elements can have exposed back surfaces. When the seat is in the closed position and the lid is in the open position, the first and second rotatable elements can have exposed middle surfaces. When the seat and lid are in the open position, the first and second rotatable elements can have exposed front surfaces. In some disclosed embodiments, the first and second rotatable elements rotate independently without creating any sharp corners. For example, the various exposed surfaces of the first and second rotatable elements can be substantially flush with adjacent exposed surfaces as the seat or lid is moved between the closed position and the open position.

Some disclosed embodiments of the toilet seat hinge have front, back and side surfaces. When installed on a standard toilet body, the front surface is the surface that faces the bowl, the back surface is the surface that faces the tank, and the side surfaces are the surfaces that are parallel with the sides of the toilet body. In some disclosed embodiments, the front surface of the hinge abuts the mounting surface at a front surface junction and has a flared bottom portion adjacent to the front surface junction. The back and side surfaces also can have flared bottom portions adjacent to back and side surface junctions, respectively. The flared bottom portions of the front, back or side surfaces can be configured to substantially abut the mounting surface without creating sharp corners along at least a portion of the front, back or side surface junctions, respectively. The portion along the front, back or side surface junction without sharp corners can be, for example, the entire length of the front, back or side surface junction or the majority of the length of the front, back or side surface junction. Sharp corners can be eliminated, for example, by tapering the flared bottom portions so as to make the front back or side surfaces at least partially concave.

The first and second rotatable elements typically have a substantially rounded cross section. In contrast, the seat and lid typically have a substantially flat cross section. In conventional toilet seat assemblies, sharp corners are created between the rotatable elements and the seat and lid. In contrast, some disclosed embodiments are designed to eliminate these sharp corners. The seat can comprise a seat attachment portion that attaches to a rotatable element at a seat attachment area. Similarly, the lid can comprise a lid attachment portion that attaches to a rotatable element at a lid attachment area. Each attachment portion can have a top surface and a bottom surface. In some disclosed embodiments, there are no sharp corners along at least a portion of the top or bottom surfaces of the seat or lid attachment portion where they meet the rotatable elements. These sharp corners can be eliminated, for example, by making the top or bottom surfaces of the attachment portions at least partially concave. In some disclosed embodiments, at least two of the top surface of the seat attachment portion, the bottom surface of the seat attachment portion, the top surface of the lid attachment portion, and the bottom surface of the lid attachment portion are at least partially concave.

Mounting on a Toilet Body

Disclosed embodiments of the toilet seat hinge are designed to be mounted on toilet bodies, such as standard toilet bodies or non-standard toilet bodies. Some disclosed embodiments have bolt holes for this purpose. Since the bolts are stationary, the bolt holes typically are positioned so that the bolts do not interfere with the rotatable elements. The bolt holes, for example, can be positioned in fixed elements. In some disclosed embodiments, the bolt holes are positioned below the first and second rotatable elements in the cradle formed by the base. In other embodiments, the bolt holes are positioned in towers. For example, some disclosed embodiments comprise a first tower with a first bolt hole positioned over a first mounting hole and a second tower with a second bolt hole positioned above a second mounting hole. For mounting on a standard toilet body, the bolt holes can be separated by the standard distance separating the mounting holes, such as a distance of approximately 14 centimeters (5.5 inches).

The bolts used to attach a toilet seat assembly to a toilet body typically have bolt heads. Some disclosed embodiments are configured to eliminate sharp corners around the bolt heads. This can be done, for example, by making the top surface of the bolt heads flush with, or recessed relative to, the surface of the hinge. Alternatively, the bolt heads can be positioned above the surface of the hinge but rounded or otherwise contained within rounded bulges. In some disclosed embodiments, the bolt heads are positioned within openings that are recessed relative to the surface of the hinge so as to provide room for the bolt heads to be positioned below the surface of the hinge. The openings also can be covered with bolt hole covers. These bolt hole covers can be flush with the surrounding surface or slightly bulged or recessed with respect to the surrounding surface. In some disclosed embodiments, when the toilet seat needs to be removed, the bolt hole covers can be snapped out of the openings.

To create surfaces with a high degree of continuity, some disclosed embodiments do not include exposed access openings for accessing the bolts. These embodiments can be configured, for example, to receive the bolts through a bottom surface that is adjacent to the mounting surface when the hinges are installed on a toilet body. The bolts can be manipulated from below the mounting surface. For example, some disclosed embodiments are configured to receive the bolt heads through the bottom surface and to allow the bolt heads to be shifted so that they catch on a lip. The bolts then can be tightened with a nut below the mounting surface. Alternatively, disclosed embodiments can be configured to receive the shaft of the bolts, such as within a threaded opening. These and other embodiments can be attached to a toilet body using bolts with or without bolt heads. In either case, an adjustable nut can be positioned below the mounting surface to hold the hinge in place.

Construction

Some embodiments of the disclosed toilet seat hinge are designed to be manufactured with a seat and a lid as a toilet seat assembly. For example, some disclosed embodiments are designed to be compatible with conventional manufacturing processes. Conventional toilet seat assemblies often are made of molded materials. Toilet seats comprising an embodiment of the disclosed toilet seat hinge can be manufactured, for example, as several molded pieces that fit together. Some disclosed embodiments of toilet seat assemblies comprising embodiments of the disclosed toilet seat hinge can be manufactured as a first piece comprising a base, a second piece comprising a seat and a first rotatable element and a third piece comprising a lid and a second rotatable element. The first, second and third pieces, can be assembled alone or with other components to form the toilet seat assembly.

Injection molding is one example of a method for making the components of certain disclosed embodiments. When making these components using molding processes, it often is difficult to form narrow elements and sharp points. In some disclosed embodiments, the elements with these features can be modified to be more compatible with molding processes. For example, as seen in the exemplary embodiment illustrated in FIGS. 2A-2C, the front flared bottom portion 40 of the illustrated embodiment has a small edge adjacent to the front surface junction 64. Similarly, the back flared bottom portion 42 of the illustrated embodiment has a small edge adjacent to the back surface junction 66. Small edges also can be found in some disclosed embodiments on the top and bottom surfaces of the seat and lid attachment portions, for example, where they are exposed to slidably abut separate elements, such as towers and separate rotatable elements. Examples of this type of small edge also can be seen in FIGS. 2A-2C. By incorporating small edges instead of sharp points, components of some embodiments of the toilet seat hinge can be manufactured more easily with molding processes. In comparison to components that end in sharp points, components that end in small edges also have increased strength and an increased tendency to hold their shape over time. The small edges can be of varying sizes. As discussed above, small edges are not considered when calculating the angle of the surface ending in the small edge.

In some disclosed embodiments, the number of small edges and the size of the small edges are minimized as much as possible. Some disclosed embodiments, particularly embodiments constructed of very hard materials, have edges smaller than about 3 millimeters, such as smaller than about 2 millimeters or smaller than about 1 millimeter. Embodiments of the toilet seat hinge also can comprise components that end in sharp points with substantially no small edges. Certain modem injection molding techniques known to persons of ordinary skill in the art are capable of forming high quality components to tight manufacturing tolerances. In embodiments that include a conformable pad adjacent to the mounting surface, the conformable pad can have edges cut at angles such that the bottom portions of the conformable pad extend outward farther than the top portions. This can help to minimize interruption of the curvature of the front, back and/or side surfaces as they approach the mounting surface.

The disclosed toilet seat hinge and toilet seat assemblies comprising the disclosed hinge can be made of a variety of materials, including plastic, which currently is used to make most conventional toilet seat hinges. Some disclosed embodiments are made of materials that are harder than conventional materials used to make toilet seat hinges. For example, some disclosed embodiments are made of materials harder than polypropylene. Components made of harder materials can be manufactured to more exacting tolerances. The finished components also are better able to fit tightly against each other and to form narrow shapes without deforming over time. Some disclosed embodiments are made of materials such as metal, ceramic, glass, hard plastics and resins, such as epoxy resins.

In some disclosed embodiments, different portions are made of different materials. For example, in embodiments in which bolts are received by threaded channels, the threaded channels can be made of metal and embedded in another material, such as epoxy resin. Similarly, in embodiments that comprise an axle, the axle can be made of metal, while other components are made of one or more different materials.

Injection molding processes allow objects to be formed with or without substantial voids. Voids can be used to reduce the cost of materials and reduce the weight of the molded object. Embodiments of the disclosed toilet seat hinge can be formed with or without substantial voids. Certain materials make it possible to achieve acceptable quality in components that are at least partially hollow. In many embodiments, however, substantially solid construction is preferred.

Some disclosed embodiments comprise components that slide against other components. To keep these tight-fitting components moving smoothly, they can be made of materials that that tend to slide easily. For example, components of disclosed embodiments can be made of materials with smooth surfaces that exhibit low friction when rubbed against adjacent components. Alternatively, some friction may be desirable to prevent the seat and lid from slamming.

Additional Features

To eliminate sharp corners, some disclosed embodiments are configured so that the seat and lid are attached well above the mounting surface. There also can be a height difference between the seat and the lid near the hinge. To support sufficient weight, portions of the seat typically must rest on the surface of the edge of the bowl when the seat is closed. Similarly, portions of the lid typically rest on the seat when the lid is closed. Thus, some disclosed embodiments are designed to span the vertical spaces between the toilet body, the seat and the lid. This can be done, for example, by giving the seat or lid a downward slope as it extends away from the hinge area. In another example, risers span the height differences. With respect to the seat, these risers can be any elements that span the space between the seat and the surface of the edge of the bowl when the seat is closed. For example, the risers can be oblong shaped protrusions positioned on the bottom of the seat. The lid also can comprise risers to span the space between the lid and the seat when the lid and seat are closed. The risers below the lid typically do not need to be as strong as the risers below the seat because the lid typically does not need to support large amounts of weight.

As disclosed above, in some disclosed embodiments, the base is configured to cover a portion of the mounting surface. Typical toilet bodies are made of ceramic and the mounting surfaces can be uneven. To more effectively cover uneven mounting surfaces, some disclosed embodiments comprise a conformable pad configured to be positioned between the hinge and the mounting surface when the hinge is installed on a toilet body. This conformable pad conforms to the bottom surface of the hinge and the mounting surface and helps to eliminate gaps between the two surfaces. The conformable pad typically has a footprint on the mounting surface matching the footprint of the base. In some disclosed embodiments, the conformable pad also increases the friction between the hinge and the mounting surface so that the toilet seat assembly remains stationary on the mounting surface. The conformable pad can be made of any conformable material, such as natural or synthetic rubber.

Some disclosed embodiments include conformable pads positioned at other junctions, such as between and around various moving components. Conformable pads can help to minimize gaps at these junctions by conforming to the surfaces being joined. For example, conformable pads, such as disks, can be positioned between adjacent rotatable elements. Suitable conformable materials for use adjacent to moving elements include soft plastics.

The tight-fitting movable components in some disclosed embodiments can be configured to move with varying amounts of resistance. This resistance can be modified, for example, by modifying the force holding the components together. In some disclosed embodiments, there is sufficient friction between a first rotatable element and adjacent elements to hold the seat in place at any point between the closed position and the open position. Similarly, the friction between a second rotatable element and adjacent elements can be enough to hold the lid in place at any point between the closed position and the open position. This is helpful to prevent the seat and lid from slamming against each other or the toilet body.

Additional Embodiments

In addition to the disclosed embodiments, many other embodiments will be apparent to those of ordinary skill in the art from a consideration of this specification, or practice of the invention disclosed herein. It is intended that the specification be considered as exemplary only, with the true scope and spirit of the invention being indicated by the following claims.

I claim:

1. A toilet seat assembly, comprising:

a seat;

a lid; and a hinge including a first rotatable element attached to the seat and a second rotatable element attached to the lid, wherein the hinge has a substantially unified footprint configured to cover a continuous path between a first mounting hole and a second mounting hole on a mounting surface of a toilet body when the toilet seat assembly is mounted on the toilet body, the first and second rotatable elements rotate on substantially the same axis, the seat substantially abuts the second rotatable element, the lid substantially abuts the first rotatable element, there are substantially no exposed gaps between the first rotatable element and the mounting surface of the toilet body when the toilet seat assembly is mounted on the toilet body, and there are substantially no exposed gaps between the second rotatable element and the mounting surface of the toilet body when the toilet seat assembly is mounted on the toilet body.

2. The toilet seat assembly according to claim 1, wherein the first rotatable element is attached to a seat attachment portion of the seat, the seat attachment portion of the seat having a top surface and a bottom surface, the second rotatable element is attached to a lid attachment portion of the lid, the lid attachment portion of the lid having a top surface and a bottom surface, and at least two of the top surface of the seat attachment portion, the bottom surface of the seat attachment portion, the top surface of the lid attachment portion, and the bottom surface of the lid attachment portion are substantially concave.

3. The toilet seat assembly according to claim 1, wherein the hinge includes one or more fixed elements, there are substantially no sharp corners between the first and second rotatable elements as the seat or the lid is moved between the closed position and the open position, and there are substantially no sharp corners between the first and second rotatable elements and the one or more fixed elements as the seat or the lid is moved between the closed position and the open position.

4. The toilet seat assembly according to claim 1, wherein the hinge includes one or more fixed elements, there are substantially no exposed gaps between the first and second rotatable elements as the seat or the lid is moved between the closed position and the open position, and there are substantially no exposed gaps between the first and second rotatable elements and the one or more fixed elements as the seat or the lid is moved between the closed position and the open position.

5. The toilet seat assembly according to claim 1, wherein the first and second rotatable elements each have exposed back surfaces when the seat and the lid are in a closed position, the first and second rotatable elements each have exposed middle surfaces when the seat is in the closed position and the lid is in an open position, the first and second rotatable elements each have exposed front surfaces when the seat and the lid are in the open position, the exposed back surfaces of the first and second rotatable elements each are substantially flush with adjacent exposed back surfaces as the seat or the lid is moved between the closed position and the open position, the exposed middle surfaces of the first and second rotatable elements each are substantially flush with adjacent exposed middle surfaces as the seat or the lid is moved between the closed position and the open position, and the exposed front surfaces of the first and second rotatable elements each are substantially flush with adjacent exposed front surfaces as the seat or the lid is moved between the closed position and the open position.

6. The toilet seat assembly according to claim 1, wherein the hinge has a front surface configured to substantially abut the mounting surface of the toilet body to form a substantially concave front surface junction when the toilet seat assembly is mounted on the toilet body, and the hinge has a back surface configured to substantially abut the mounting surface of the toilet body to form a substantially concave back surface junction when the toilet seat assembly is mounted on the toilet body.

7. The toilet seat assembly according to claim 1, wherein the first and second rotatable elements each have exposed back surfaces when the seat and the lid are in a closed position, and the exposed back surfaces of the first and second rotatable elements each are substantially flush with adjacent exposed back surfaces as the seat or the lid is moved between the closed position and an open position.

8. The toilet seat assembly according to claim 1, wherein the first and second rotatable elements each have exposed middle surfaces when the seat is in a closed position and the lid is in an open position, and the exposed middle surfaces of the first and second rotatable elements each are substantially flush with adjacent exposed middle surfaces as the seat or the lid is moved between the closed position and the open position.

9. The toilet seat assembly according to claim 1, wherein the first and second rotatable elements each have exposed front surfaces when the seat and the lid are in an open position, and the exposed front surfaces of the first and second rotatable elements each are substantially flush with adjacent exposed front surfaces as the seat or the lid is moved between a closed position and the open position.

10. A toilet seat assembly, comprising:

a seat;

a lid; and a hinge including one or more fixed elements and two or more rotatable elements, wherein the hinge allows the independent movement of the seat and the lid between a closed position and an open position, the seat either is connected to or slidably abuts the hinge along substantially the entire length of a portion of the hinge extending between a first mounting hole and a second mounting hole on a mounting surface of a toilet body when the toilet seat assembly is mounted on the toilet body, the lid either is connected to or slidably abuts the hinge along substantially the entire length of the portion of the hinge extending between the first mounting hole and the second mounting hole on the mounting surface of the toilet body when the toilet seat assembly is mounted on the toilet body, there are substantially no exposed gaps between the hinge and the mounting surface of the toilet body when the toilet seat assembly is mounted on the toilet body, and the hinge has a substantially unified footprint configured to cover a continuous path between the first mounting hole and the second mounting hole on the mounting surface of the toilet body when the toilet seat assembly is mounted on the toilet body.

11. The toilet seat assembly according to claim 10, wherein there are substantially no sharp corners between the two or more rotatable elements as the seat or the lid is moved between the closed position and the open position, and there are substantially no sharp corners between the two or more rotatable elements and the one or more fixed elements as the seat or the lid is moved between the closed position and the open position.

12. The toilet seat assembly according to claim 10, wherein the two or more rotatable elements rotate on substantially the same axis.

13. The toilet seat assembly according to claim 10, wherein the two or more rotatable elements include a first rotatable element attached to the seat and a second rotatable element attached to the lid, the first and second rotatable elements each have exposed back surfaces when the seat and the lid are in the closed position, and the exposed back surfaces of the first and second rotatable elements each are substantially flush with adjacent exposed back surfaces as the seat or the lid is moved between the closed position and the open position.

14. The toilet seat assembly according to claim 10, wherein the two or more rotatable elements include a first rotatable element attached to the seat and a second rotatable element attached to the lid, the first and second rotatable elements each have exposed middle surfaces when the seat is in the closed position and the lid is in the open position, and the exposed middle surfaces of the first and second rotatable elements each are substantially flush with adjacent exposed middle surfaces as the seat or the lid is moved between the closed position and the open position.

15. The toilet seat assembly according to claim 10, wherein the two or more rotatable elements include a first rotatable element attached to the seat and a second rotatable element attached to the lid, the first and second rotatable elements each have exposed front surfaces when the seat and the lid are in the open position, and the exposed front surfaces of the first and second rotatable elements each are substantially flush with adjacent exposed front surfaces as the seat or the lid is moved between the closed position and the open position.

16. The toilet seat assembly according to claim 10, wherein the hinge includes a conformable pad configured to be positioned adjacent to the mounting surface of the toilet body when the toilet seat assembly is mounted on the toilet body.

17. The toilet seat assembly according to claim 10, wherein the one or more fixed elements include a base with a first tower and a second tower, the two or more rotatable elements include a first rotatable element attached to the seat and a second rotatable element attached to the lid, the first and second towers are configured to be positioned directly above the first and second mounting holes, respectively, on the mounting surface of the toilet body when the toilet seat assembly is mounted on the toilet body, the first and second towers each include a fixed bolt or a bolt opening, and the first and second rotatable elements are positioned between the first and second towers.

18. The toilet seat assembly according to claim 10, wherein there are substantially no exposed gaps between the two or more rotatable elements as the seat or the lid is moved between the closed position and the open position, and there are substantially no exposed gaps between the two or more rotatable elements and the one or more fixed elements as the seat or the lid is moved between the closed position and the open position.

19. A toilet seat assembly, comprising:

a seat;

a lid; and a hinge including one or more fixed elements and two or more rotatable elements, wherein the hinge allows the independent movement of the seat and the lid between a closed position and an open position, the seat either is connected to or slidably abuts the hinge along substantially the entire length of a portion of the hinge extending between a first mounting hole and a second mounting hole on a mounting surface of a toilet body when the toilet seat assembly is mounted on the toilet body, the lid either is connected to or slidably abuts the hinge along substantially the entire length of the portion of the hinge extending between the first mounting hole and the second mounting hole on the mounting surface of the toilet body when the toilet seat assembly is mounted on the toilet body, there are substantially no exposed gaps between the hinge and the mounting surface of the toilet body when the toilet seat assembly is mounted on the toilet body, the hinge has a front surface configured to substantially abut the mounting surface of the toilet body to form a substantially concave front surface junction when the toilet seat assembly is mounted on the toilet body, and the hinge has a back surface configured to substantially abut the mounting surface of the toilet body to form a substantially concave back surface junction when the toilet seat assembly is mounted on the toilet body.

20. A toilet seat assembly, comprising:

a seat;

a lid; and a hinge including one or more fixed elements and two or more rotatable elements, wherein the hinge allows the independent movement of the seat and the lid between a closed position and an open position, the seat either is connected to or slidably abuts the hinge along substantially the entire length of a portion of the hinge extending between a first mounting hole and a second mounting hole on a mounting surface of a toilet body when the toilet seat assembly is mounted on the toilet body, the lid either is connected to or slidably abuts the hinge along substantially the entire length of the portion of the hinge extending between the first mounting hole and the second mounting hole on the mounting surface of the toilet body when the toilet seat assembly is mounted on the toilet body, there are substantially no exposed gaps between the hinge and the mounting surface of the toilet body when the toilet seat assembly is mounted on the toilet body, the two or more rotatable elements include a first rotatable element attached to a seat attachment portion of the seat and a second rotatable element attached to a lid attachment portion of the lid, the seat attachment portion has a top surface and a bottom surface, the lid attachment portion has a top surface and a bottom surface, and at least two of the top surface of the seat attachment portion, the bottom surface of the seat attachment portion, the top surface of the lid attachment portion, and the bottom surface of the lid attachment portion are substantially concave.

* * * * *